US005426274A

United States Patent [19]

Brüggemann et al.

[11] Patent Number: 5,426,274

[45] Date of Patent: Jun. 20, 1995

[54] PUSH BUTTON SWITCH

[75] Inventors: Ulrich Brüggemann, Heustreu; Gerhard Hochgesang, Bad Neustadt/Saale; Hans-Karl Heil, Wildflecken, all of Germany

[73] Assignee: Preh-Werke GmbH & Co. KG, Saale, Germany

[21] Appl. No.: 183,953

[22] Filed: Jan. 19, 1994

[30] Foreign Application Priority Data

Jan. 19, 1993 [DE] Germany ..... 43 01 213.2

[51] Int. Cl.[6] ..... H01H 13/56

[52] U.S. Cl. ..... 200/523; 200/524; 200/447; 200/449; 200/450

[58] Field of Search ..... 200/523, 524, 520, 447, 200/449, 450, 457, 529, 538, 537, 239

[56] References Cited

U.S. PATENT DOCUMENTS 3,315,535 4/1967 Stevens ..... 200/524

FOREIGN PATENT DOCUMENTS 1300603 8/1969 Germany .
1590503 11/1970 Germany .
2116776 12/1971 Germany ..... H01H 13/56
1690203 5/1972 Germany ..... H01H 13/22
2065104 7/1972 Germany ..... H01H 13/56
DE 3150046 7/1983 Germany ..... H01H 13/56
DE 3332371 1/1984 Germany ..... H01H 13/56
DE 3545938 6/1987 Germany ..... H01H 13/56
DE 3644437 5/1988 Germany ..... H01H 13/56

*Primary Examiner*—Henry J. Recla
*Assistant Examiner*—David J. Walczak
*Attorney, Agent, or Firm*—Griffin, Butler Whisenhunt & Kurtossy

[57] ABSTRACT

A push button switch, particularly a master switch, has housing-affixed contacts (4, 7) and at least one contact bridge (8, 9) movable by a spring plunger (10). A spring-switching mechanism (24, 25, 26) is operatively coupled between the spring plunger and a manually-movable sliding switch, or switch actuator, (22). A guiding, or sliding, locking linkage apparatus for the sliding switch (22), which includes two locking parts, a first of which is a track (27) and a second of which is a follower lever (28) for engaging the track. Upon alternate depressions of the sliding switch, the sliding switch alternately moves between "on" and "off" positions. In order to prevent damage to the locking apparatus upon a pulling of the sliding switch in a direction opposite to a direction of depression of the sliding switch, the first and second locking parts release from the housing to follow movement of the sliding switch.

5 Claims, 4 Drawing Sheets

PUSH BUTTON SWITCH

BACKGROUND OF THE INVENTION

This invention concerns a push button switch, particularly, a master, or power, switch, having: housing-affixed contacts and at least one contact bridge for bridging the contacts that is movable by means of a spring plunger; an over-center spring-switching mechanism that is operatively coupled between the spring plunger and a manually-movable sliding switch; and a sliding locking linkage for the sliding switch which includes a groove and a follower peg which engages in the groove, whereby the sliding switch, upon being depressed against the force of a return spring, shoves the first locking part along the second locking part and alternately changes between "on" and "off" positions.

Such switches are often used for controlling electrical power to consumer appliances, particularly television-like devices.

German Auslegeschrift DE-AS 1 590 503 discloses such a push button switch. The locking device disclosed therein is part of an engaging spring which is mounted on a housing and which engages a groove in a sliding switch.

Similar push button switches are disclosed German patent publications DE 35 45 938 A1, DE-AS 1 300 603, DE-PS 1 690 203, DE-OS 20 65 104, DE-AS 21 16 776, DE-OS 31 50 046 and DE-OS 33 32 371. In all of these push button switches the problem exists that when the respective sliding switch is forcibly loaded in a direction opposite to its normal manual depression direction, the danger arises that a locking linkage thereof will be damaged. One must consider that such improper manipulations will be made because consumers do not always know, from the beginning, proper operating procedures. The danger of damaging the push button switches upon forcible improper manipulations thereof also arises because sliding locking linkages must be constructed to be quite small and are usually of resinous plastic material; thus, it cannot be assumed that all parts, without further measures, are arranged to be sufficiently sturdy that they can withstand forceful improper manipulations.

German Patent DE-PS 36 44 437 discloses a push button switch with a gliding, or sliding, locking linkage in which a locking, or sliding, element is shiftably held by means of a spring. This spring device protects the locking linkage from overloading in a keying, or depressing, direction.

It is an object of this invention to provide a push button switch of the type mentioned in the first paragraph of the "BACKGROUND OF THE INVENTION" above in which, upon a manual loading of the push button switch in a direction opposite to a keying, or depressing direction, the danger that the locking linkage will be damaged does not arise.

SUMMARY

According to principles of this invention the above object of the invention is achieved with a push button switch in which the locking linkage comprises first and second locking parts, with the first locking part being integral with the sliding switch and the second locking part being pressed against a bearing surface of the housing by means of a return spring of the sliding switch so as not to be slidable with the sliding switch when the sliding switch is depressed, but which, upon a manual pulling of the sliding switch in a direction opposite to a depressing direction, is movable with the sliding switch so that it can follow movement of the first locking part, with which the second locking part is engaged.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
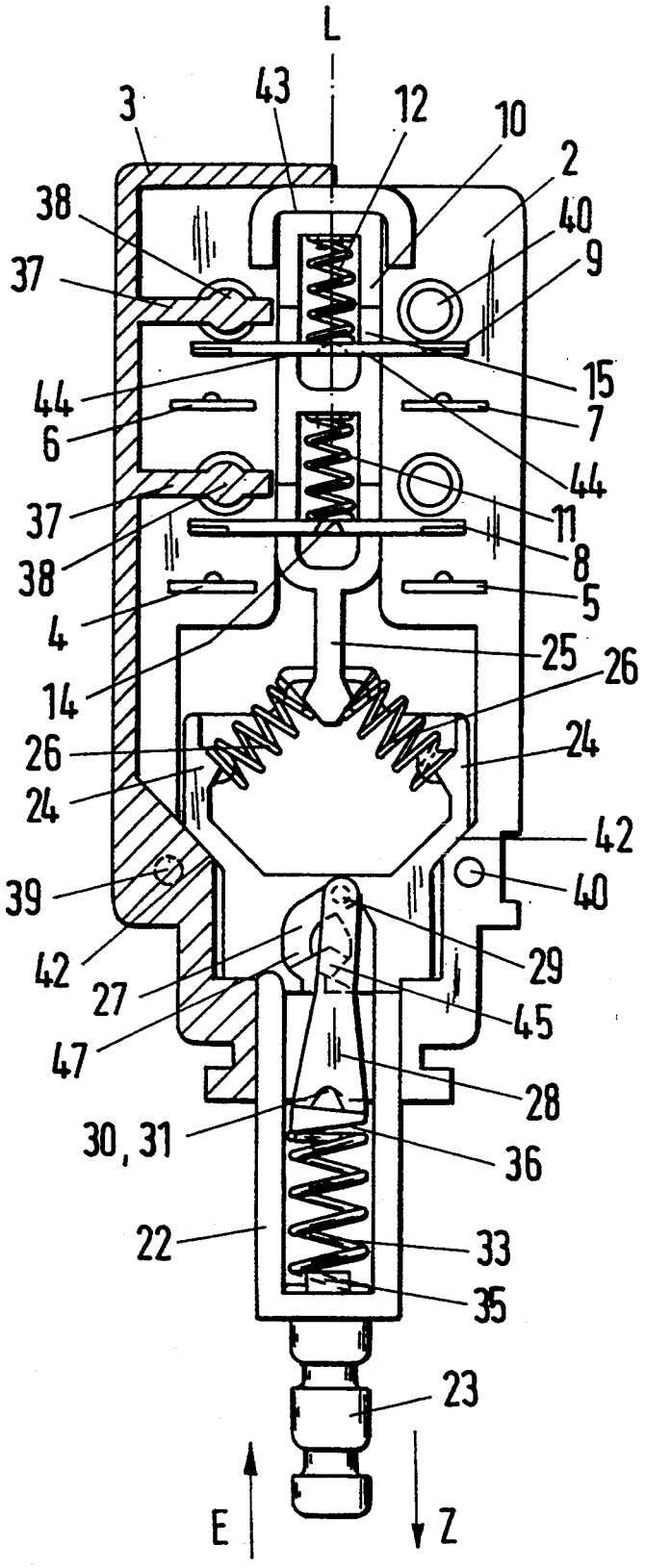
FIG. 1 is a cutaway, partially sectional, side view of a push button switch of this invention in an "off" position.

A housing 1 of a push button switch has a floor, or frame, part 2 and a cover 3. Two pairs of contacts 4, 5 and 6, 7 are attached to the floor part 2. Each contact pair 4, 5 and 6, 7 is respectively facing a contact bridge 8, 9. Basically, the push button switch 1 is a two-pole switch.

A spring plunger 10 is slidably mounted on the floor part 2 to be slidable in a direction of a length axis L. The spring plunger 10 has two chambers in which compression springs 11, 12 are mounted. These are respectively supported, or attached at one end by a lug 13 of the respective chamber and at the other end by one of the contact bridges 8, 9. The contact bridges 8, 9 have, for this purpose, an impression, or protrusion, 14. The contact bridges 8, 9 extend on each side of the length axis L through openings 15 in the spring plunger 10, in which they have play, or clearance.

An elastic spring tongue 16 is formed on the spring plunger 10 which interacts with a protrusion 17 of the floor part 2 in a manner which is described in more detail below. A first inclined surface 18 of the protrusion 17 and a first inclined surface 19 of the tongue 16 form a first rubbing surface pair. A second incline surface 20 of the protrusion 17 and a second inclined surface 21 of the tongue 16 form a second rubbing surface pair (compare FIGS. 1 and 2).

A sliding switch, switch actuator, switch button, or shover, 22 is slidably positioned on the floor part 2 to be slidable in a direction of the length axis L, to extend outside of the housing 1 in a direction of the length axis L, and to form, outside of the housing 1, a receiving plug, or mount, 23 for a push button which is not shown in any further detail.

The switch actuator 22 has an arm 24 on each side of the length axis L. Between each arm 24 and an extension 25 of the spring plunger 10 is arranged a compression, or expanding, spring 26. In this manner a snapping switch mechanism is formed between the spring plunger 10 and the switch actuator 22.

A somewhat heart-shaped groove (or first locking part) 27 is formed on, or integral with, the switch actuator 22 which serves as a guide for a follower lever 28. The follower lever 28 engages with its hexagonal peg 29, hexagonal as seen in profile or cross section, in the groove 27. On an exterior end of the floor part 2 a rounded notch 30 is provided in which a rounded boss 31 of the follower lever 28 engages. The follower lever 28 has, in addition, facing away from the floor part 2, a boss, or shoulder, 32 which engages with an expanding spring 33 which simultaneously serves as a return spring 33 for the switch actuator 22. The return spring 33 lies in a chamber 34 of the switch actuator 22 and is held therein by a protrusion 35.

Figure 2:
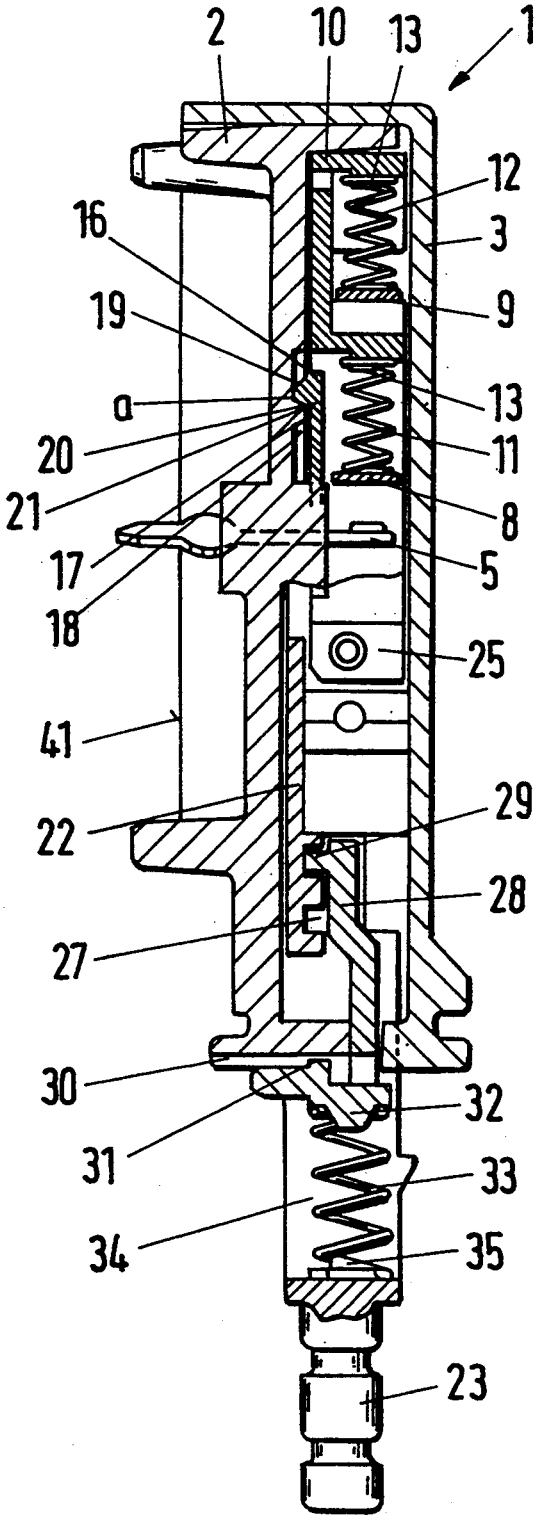
FIG. 2 is a view taken with the push button switch of FIG. 1 being rotated about is longitudinal axis 90° and shown partially in cross section and partially cut away.
Figure 4:
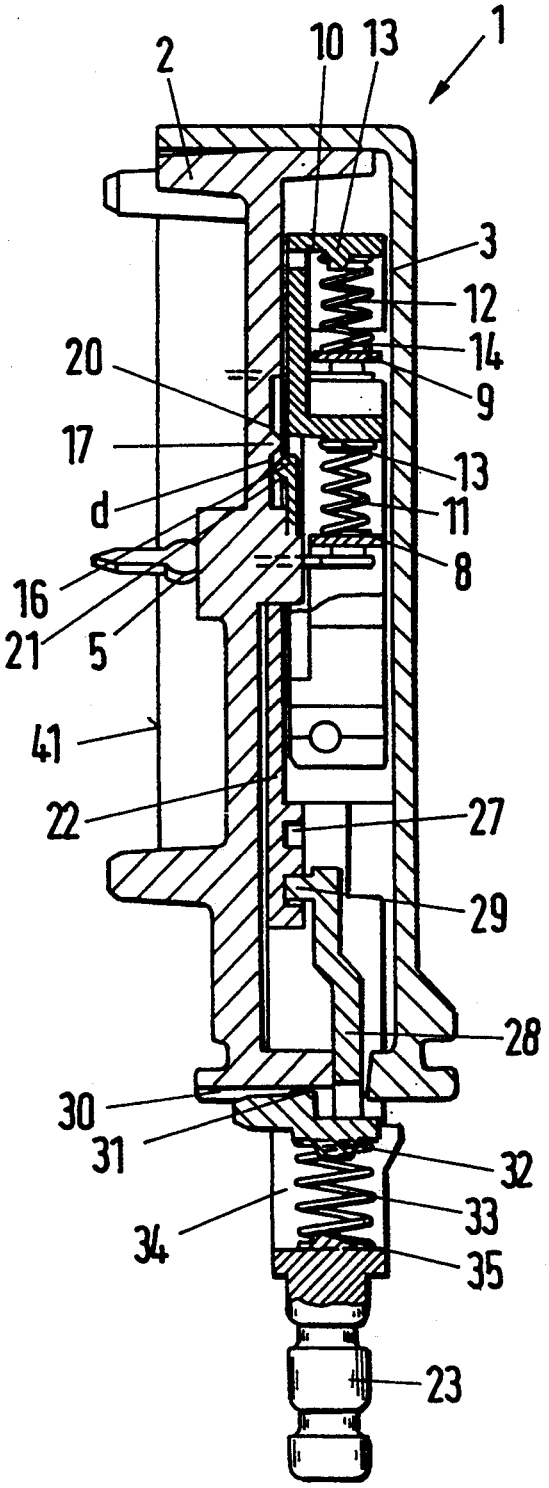
FIG. 4 is a mostly cross-sectional, but partially cutaway, view taken on line IV—IV in FIG. 3.

The boss 31 of the follower lever 28 is displaced laterally from a working surface of the return spring 33 at the boss, or shoulder, 32 (see FIGS. 2 and 4). In this manner, a turning moment is created that presses the peg 29 of the follower lever 28 in the groove 27.

Figure 3:
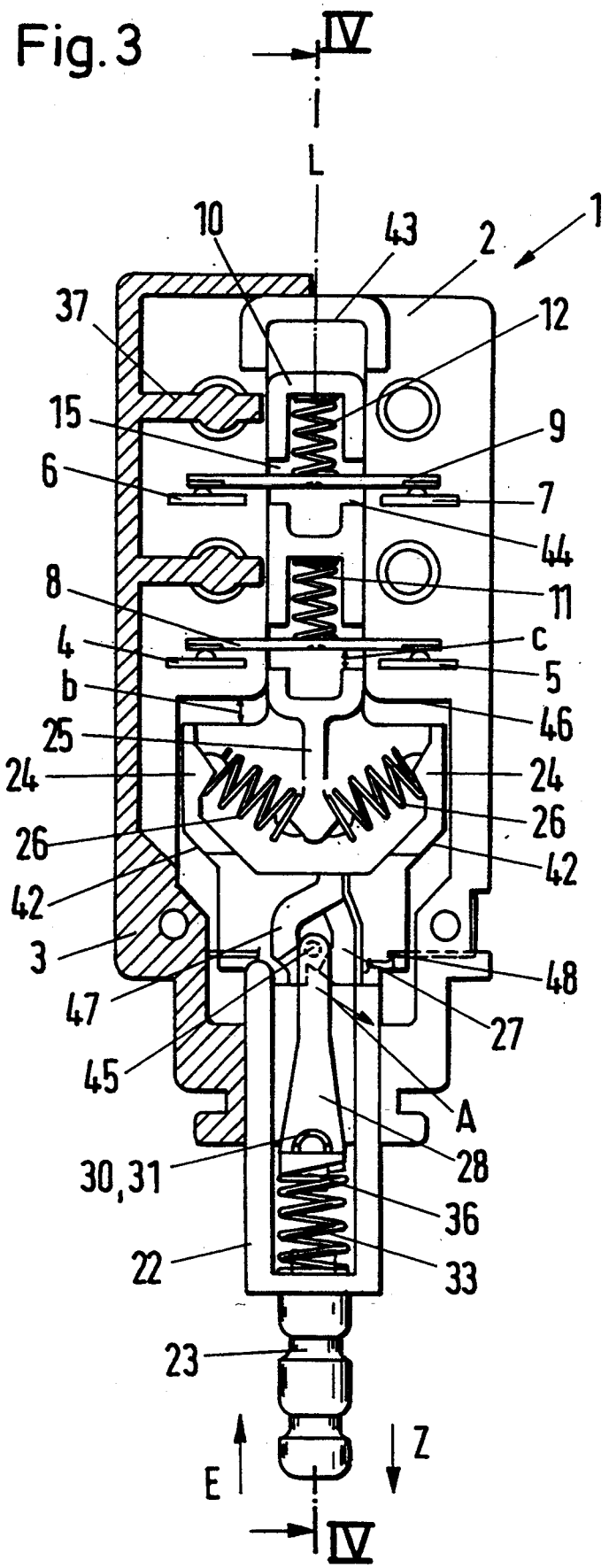
FIG. 3 is a view similar to FIG. 1, but with the push button switch in an "on" position.

The follower lever 28 has on its end facing the return spring 33 an incline surface 36 so that the follower lever has a tendency, at the mounting notch 30, to preferably swing with its hexagonal peg 29 to the right, as seen in FIGS. 1 and 3.

The described push button switch is mechanically uncomplicated to assemble. In this regard, all parts can be inserted from the same side (as seen in FIG. 1 from a direction perpendicular to the plane of the drawing and in FIG. 2 from a direction perpendicular to the relatively flat floor part 2). Also, the described springs can be relatively easily mechanically assembled. The cover plate 3 which is only shown to the left of the length axis in FIGS. 1 and 3, is mounted from the same direction. Lugs 38 and 39 formed on ribs 37 of the corner plate 3 engage thereby in bores 40 of the floor part 2. A lower surrounding edge 41 of the floor part 2 provides a receiving, or contact, surface for a circuit board that is not shown in further detail, to which the contacts 4 through 7 can be coupled. The contacts 4 through 7 lie protected within the edge 41 so that no outside particles can reach the contacts 4 through 7.

Operation of the described push button switch is substantially as follows:

When the push button switch is in the "off" position depicted in FIGS. 1 and 2 the switch actuator 22 is urged, by means of the return spring 33, against stops 42. The expanding springs 26 are relatively relaxed and the spring plunger 10 is urged by these springs against a stop 43. The compression springs 11, 12 urge the contact bridges 8, 9 against edges 44 defining the openings 15. The contact bridges 8, 9 are thereby spaced from the contacts 4, 5 and 6, 7.

If it is desired to switch the push button switch the switch actuator 22 is then shoved in the depressing direction E. A guiding portion 47 of the groove 27 slides along the peg 29 of the follower lever 28. When the switch actuator 22 is depressed the expanding springs 26 are compressed, or tensioned, until they pass over a center point. Until that point, the spring plunger 10 remains unmoved. After the over-center point has been passed, the expanding springs 26 operate in a opposite direction so that the spring plunger 22 is now urged in a direction opposite the depressing direction E. After a sudden first freeing stroke movement "a" (see FIG. 2), the second inclined surface 21 of the tongue 16 engages with the second inclined surface 20 of the protrusion 17 whereby the inclined surfaces now frictionally lie against one another as rubbing surfaces. These rubbing surfaces now glide on one another causing a swinging, or giving, of the tongue 16, whereby movement of the spring plunger 10 is braked so that the contact bridges 8 and 9, then braked, come into engagement with the contacts 4, 5 and 6, 7. In this manner, a contact vibration, or bounce, is avoided or at least reduced. After the contact bridges 8 and 9 have made contact with the contacts 4, 5 and 6, 7, the spring plunger 10 moves only so far further that the edges 44 defining the openings 15 are spaced from the contact bridges 8 and 9. The contact pressure is now guaranteed by the compression springs 11 and 12.

When the switch actuator is released, the peg 29 of the follower lever 28 goes into an engaging receiver, or notch, 45 of the groove 27. The push button switch is now in the "on" position shown in FIGS. 3 and 4.

If during a switching operation the switch actuator 22 and its push button were strongly pulled in a pull direction Z in a manner not intended, then, for switches in the prior art, the guiding apparatus, namely, the groove 27 or the follower lever 28 would be damaged. However, if in the described push button switch the switch actuator 22 were pulled in the direction Z, then the groove 27 carries the follower lever 28 in the direction Z. This is possible because the follower lever 28, in this direction Z, is not supported by the housing 1 but rather is supported by the return spring 33. The switch actuator 22 therefore allows movement in the pull direction Z. If, upon such a manipulation of the switch actuator 22, it is moved so far that it engages at the stops 42, then the spring plunger snaps by means of the expanding springs 26 of the spring-switching mechanism out of the "on" position into the "off" position, as is further described below.

For normally switching the push button switch from the "on" position to the "off" position, the switch actuator 22 is depressed in the direction E. When this is done, the groove 27 guides the peg 29 of the follower lever 28 so that the peg 29 leaves the engaging receiver 45, under operation of the expanding return spring 33 acting on the inclined surface 36, in a direction of an arrow A (see FIG. 3). After a short sudden stroke b, which only must be so large that the peg 29 of the follower lever 28 moves out of the engaging receiver 45, the switch actuator 22 engages an edge 46 of the floor part 2. Until this point, the spring plunger 10 is unmoved and, by means of the expanding springs 22 is held so that the compression springs 11, 12 maintain the necessary contact pressure between the contact bridges 8,9 and the contacts 4, 5 and 6, 7.

The switch actuator 22 is then released, or also manipulated to be slowly guided back in a manner not desired. In either case, it moves under force of the return spring 33, in the direction Z. When this is done, the expanding springs 26 come under increased compression until they pass a "center point". Already shortly before the center point is reached the spring plunger 10 begins to move in the direction E. Because of the clearance c between the frames 44 and the contact bridges 8, 9, the contact bridges 8, 9 do not yet contact the edges 44. Between the first inclined surface 18 of the protrusion 17 and the first inclined surface 19 of the tongue 16 there is a clearance d when the switch is in the "on" position, which is smaller than the clearance c. The inclined surfaces 18, 19, which serve as rubbing surfaces, therefore, come into contact before the edges 44 make contact with the contact bridges 8, 9. The rubbing surface pairs of the first inclined surfaces 18, 19 cause a delay, or retarding, of snapping movement of the spring plunger 10 and the contact bridges 8, 9. Only after the rubbing surfaces of the first inclined surfaces 18, 19 have glided across one another, during which the spring-loaded tongue 16 pivots and during which the tension force of the expanding springs 26 increases, the edges 44 of the spring plunger 10 engage the contact bridges 8, 9, whereby the inclined surfaces 18, 19 have released from one another. The contact bridges 8, 9 separate abruptly from the contacts 4, 5. The push button switch arrives at the "off" position depicted in FIGS. 1 and 2.

However, before the snapping point is reached, in which the contact bridges 8, 9 release from the contacts 4, 5 and 6, 7, in a jerked, sudden manner, a user can manipulate the switch actuator 22 without thereby bringing the contact bridges into positions in which they do not have sufficient contact pressure on the contacts 4, 5 and 6, 7. If the switch actuator, for example, is manipulated to an intermediate position in which the inclined surfaces 18, 19 already lie against one another and the expanding springs 26 are in the area of their over-center points, then there is thereby no dangerous increase of a transition contact electrical resistance between the contact bridges 8, 9 and the contacts 4, 5 and 6, 7, and also there is no danger of manipulated arcs being produced.

While the invention has been particularly shown and described with reference to a preferred embodiment, it will be understood by those of ordinary skill in the art that various changes in form and detail may be made therein without departing from the spirit and scope of the invention.

The inclined surface 19, which is parallel to the inclined surface 18, and the inclined surface 21, which is parallel to the inclined surface 20, can have various angles of inclination which are adapted to the described manner of operation. Normally, the inclined surfaces 18, 19 have steeper, or greater, inclination angles than the inclined surfaces 20, 21 because the inclined surfaces 18, 19 serve to enhance operation of the expanding springs 26 as force storing members and the inclined surfaces 20, 21 only operate as brakes.

It is convenient in this invention that the tongue 16 in the "on" position as well as in the "off" position - - -i.e. for most of the time - - - is not loaded and is only deflected during a switching operation. It is also possible to form the spring-loaded tongue 16 on the floor part 2 and to provide the protrusion 17 on the spring plunger 10.

The rubbing surface pairs 18, 19; 20, 21 can be also formed so that they are not inclined to the depressing direction E but rather so that they lie parallel thereto. A spring-loaded element would not be necessary if this were the case. The surfaces which would lead to an increased friction could then have appropriate surface structures.

It could also be provided that the follower lever 28 is mounted in the floor part 2. It would then be engaged by means of an auxiliary spring which makes possible its removal upon a movement in the pulling direction Z. Opposite to the described structure, it is also possible for the follower lever 28 to be mounted on the switch actuator 22 and to provide the groove 27 on the floor part 2. If the follower lever 28 does not release upon a movement of the switch actuator upon a pulling in the pulling direction Z, the groove can be so mounted that it follows movement of the follower lever 28.

In FIG. 3 a further switching contact 48 is shown. This contact serves to signal the respective switch position of the push button switch.

In this manner, it is achieved that the sliding switch, or switch actuator, presents no meaningful resistance which would damage the locking parts when it, in a locked position, particularly in the "on" position, is improperly pulled. If the sliding switch is pulled, then both of the locking parts follow this movement until the sliding switch comes against a housing-affixed stop. In this regard, a second locking part which is pressed against a member of the housing by means of the return spring and which does not slide upon depression of the sliding switch is movable upon a manual application of force to the sliding switch in a direction opposite to the depressing direction relative to the housing, whereby it can follow the movement of the other, first, locking part that is affixed to the sliding switch and with which it is engaged. A switching can thereby result which, however, does not bring with it increased danger.

In the preferred embodiment of the invention the first locking part is the groove which is formed on the sliding switch and the second locking part is the follower lever which is guided by the sliding switch, with the follower lever being urged against a contact surface of the housing by means of the return spring.

The embodiments of the invention in which an exclusive property or privilege are claimed are defined as follows:

1. A push button switch having a housing, housing-affixed contacts, at least one contact bridge for bridging the contacts that is movable by means of a spring plunger, an over-center spring-switching mechanism that is operatively coupled between the spring plunger and a manually-movable sliding switch, and a locking linkage for the sliding switch comprising first and second locking parts, one of which is a track and the other of which is a follower lever engaging the track, whereby the sliding switch, upon its depression against a force of a return spring, shoves said first locking part along the second locking part and thereby alternately switches between "on" and "off" positions:

wherein said first locking part is integral with the sliding switch and the second locking part is pressed against a bearing surface of the housing by means of the return spring of the sliding switch so as not to be slidable with said sliding switch when said sliding switch is depressed, but which upon a manual pulling of said sliding switch in a direction opposite to a depressing direction, is movable with said sliding switch so that it can follow movement of the first locking part, that is integral with the sliding switch, with which said second locking part is engaged.

2. A push button switch as in claim 1 wherein the first locking part is a groove defined by the sliding switch and the second locking part is a follower lever that is guided by the sliding switch and wherein the follower lever is urged by means of a return spring against a surface of the housing.

3. A push button switch as in claim 2 wherein the surface of the housing defines a notch in which a boss of the follower lever is pressed.

4. A push button switch as in claim 3 wherein the surface of the housing on which the boss of the follower is pressed is on the exterior surface of the housing.

5. A push button switch as in claim 3 wherein the boss is laterally displaced from a working surface of the follower lever operated on by the return spring.

* * * * *